US010116027B2

(12) United States Patent
Park et al.

(10) Patent No.: US 10,116,027 B2
(45) Date of Patent: Oct. 30, 2018

(54) RF FILTER TUNING SYSTEM AND METHOD FOR MANUFACTURING FILTER USING THE SAME

(71) Applicant: KMW INC., Hwaseong, Gyeonggi-do (KR)

(72) Inventors: Nam-Shin Park, Gyeonggi-do (KR); Joung-Hoe Kim, Gyeonggi-do (KR); Don-Yong Lee, Gyeonggi-do (KR); Kang-Hui Suh, Gyeonggi-do (KR); Jong-Youn Jung, Gyeonggi-do (KR); Sang-Hwan Cho, Gyeonggi-do (KR); Dong-Cheon Kim, Gyeonggi-do (KR); Sang-Yoong Kim, Gyeonggi-do (KR); Yong-Jin Park, Gyeonggi-do (KR); Oh-Kwon Kim, Gyeonggi-do (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 114 days.

(21) Appl. No.: 15/175,912

(22) Filed: Jun. 7, 2016

(65) Prior Publication Data

US 2017/0098878 A1 Apr. 6, 2017

Related U.S. Application Data

(63) Continuation of application No. PCT/KR2016/002191, filed on Mar. 4, 2016.

(30) Foreign Application Priority Data

Oct. 5, 2015 (KR) ..... 10-2015-0139895

(51) Int. Cl.

| | |
|---|---|
| ***H01P 1/208*** | (2006.01) |
| ***H01P 1/205*** | (2006.01) |
| *H01J 3/00* | (2006.01) |

(52) U.S. Cl.
CPC ..... *H01P 1/208* (2013.01); *H01P 1/2053* (2013.01); *H01J 3/00* (2013.01)

(58) Field of Classification Search
CPC ..... H01P 1/208; H01P 1/2053; H01J 3/00
(Continued)

(56) References Cited

U.S. PATENT DOCUMENTS

| | | | |
|---|---|---|---|
| 9,716,301 | B2 | 7/2017 | Park et al. |
| 2007/0133443 | A1 | 6/2007 | Jun et al. |

(Continued)

FOREIGN PATENT DOCUMENTS

| | | | |
|---|---|---|---|
| JP | 1994-006120 | A | 1/1994 |
| JP | 2015-510353 | A | 4/2015 |

(Continued)

*Primary Examiner* — Benny Lee
*Assistant Examiner* — Hafizur Rahman
(74) *Attorney, Agent, or Firm* — Mintz Levin Cohn Ferris Glovsky and Popeo, P.C.; Kongsik Kim; Jhongwoo Jay Peck

(57) ABSTRACT

An automatic RF filter tuning system and a method for manufacturing a filter using the same are disclosed. An RF filter tuning system for tuning an RF filter that includes a plurality of cavities having resonance elements and a cover having tuning areas that are positioned correspondingly to the resonance elements, includes a measuring unit configured to measure resonance characteristics of the cavity of the RF filter, a control unit configured to calculate a tuning value of the RF filter based on the resonance characteristics, and a tuning unit configured to tune the RF filter based on the tuning value calculated by the control unit. The tuning unit includes a striking unit configured to strike the tuning area of the cover of the RF filter, thereby adjusting the resonance value and tuning the RF filter.

17 Claims, 12 Drawing Sheets

(58) Field of Classification Search
USPC ..... 333/17.1
See application file for complete search history.

(56) References Cited

U.S. PATENT DOCUMENTS

| | | | |
|---|---|---|---|
| 2012/0161905 | A1 | 6/2012 | Lee et al. |
| 2014/0327499 | A1 | 11/2014 | Park et al. |

FOREIGN PATENT DOCUMENTS

| | | | |
|---|---|---|---|
| KR | 10-2005-0096709 | A | 10/2005 |
| KR | 10-2012-0071233 | A | 7/2012 |
| KR | 10-2013-0098205 | A | 9/2013 |
| WO | WO-2013012275 | A2 | 1/2013 |

RF FILTER TUNING SYSTEM AND METHOD FOR MANUFACTURING FILTER USING THE SAME

CROSS-REFERENCE TO RELATED APPLICATIONS

This is a continuation application of International Application No. PCT/KR2016/002191 filed on Mar. 4, 2016, which claims priority to Korean Application No. 10-2015-0139895 filed on Oct. 5, 2015. The applications are incorporated herein by reference.

TECHNICAL FIELD

The present disclosure relates to an automatic RF filter tuning system and a method for manufacturing a filter using the same.

BACKGROUND

The statements in this section merely provide background information related to the present disclosure and do not necessarily constitute prior art.

An RF filter that is a core component of a mobile communication system is manually manufactured by a skilled worker using a tuning screw in order to make up structural characteristics (process and assembly tolerances and the like).

However, such a manual process needs considerable proficiency and exhibits markedly different outputs depending on personal capability and the available manpower. Accordingly, rising labor costs lead to loss of cost competitiveness.

Besides, one of the severe problems in the manual production process lies in the fact that all the products are different from one another in their quality. Numerous companies and engineers have conducted research and development to automate the labor intensive manufacturing process, and accordingly a few products have been disclosed. However, their inherent tuning screw arrangement hindered evolution into successful automation in the RF filter production.

In order to fundamentally solve such deficiency, a bellow filter has been developed and commercialized without using a turning screw to adjust a resonance frequency, along with an automatic tuning apparatus developed for tuning the bellow filter.

However, the existing automatic tuning apparatus was manufactured in such a way that the tuning apparatus measures phase values of respective resonance elements at an input port or output port of the filter and then tunes the respective resonance elements sequentially (when tuning resonance element 1, resonance element 2 and all the rest are electrically shorted), which is followed by removal of shorting pins before the subsequent tuning session.

Here, the existing automatic tuning apparatus requires screws, which adjusts a coupling (resonance separation distance) between the resonance elements, to be manually assembled in advance to predetermined lengths, and requires a skilled worker to perform a secondary tuning if the overall characteristics of the filter fail to meet a target value even after the automatic tuning.

SUMMARY

Therefore, the present disclosure in some embodiments seeks to provide an automatic RF filter tuning system, capable of automatically perform all the processes related to a tuning process needed to adjust resonance characteristics when manufacturing the RF filter.

In accordance with some embodiments of the present disclosure, there is provided an RF filter tuning system for tuning an RF filter that includes a plurality of cavities having resonance elements and a cover having tuning areas that are positioned corresponding to the resonance elements including a measuring unit, a control unit and a tuning unit. The measuring unit is configured to measure resonance characteristics of at least one cavity of the RF filter. The control unit is configured to calculate a tuning value of the RF filter based on the resonance characteristics. The tuning unit is configured to tune the RF filter based on the tuning value calculated by the control unit. Here, the tuning unit includes a striking unit configured to strike the tuning area of the cover of the RF filter to adjust the resonance value, thereby tuning the RF filter.

In accordance with some embodiments of the present disclosure, there is provided a method for tuning an RF filter using an RF filter tuning system, wherein the RF filter includes a plurality of cavities having resonance elements and a cover having tuning areas that are positioned correspondingly to the resonance elements. The method including measuring resonance characteristics of the cavities to be tuned, striking the tuning areas by a striking unit of a tuning unit, and completing the striking when desired resonance characteristics are measured in the cavities.

According to some embodiments of the present disclosure as described above, all the processes can be automated related to a tuning process needed to adjust resonance characteristics when manufacturing an RF filter.

According to some embodiments of the present disclosure as described above, an RF filter can be mass produced fast thanks to the automation of the tuning process.

REFERENCE NUMERALS

Figure 1:
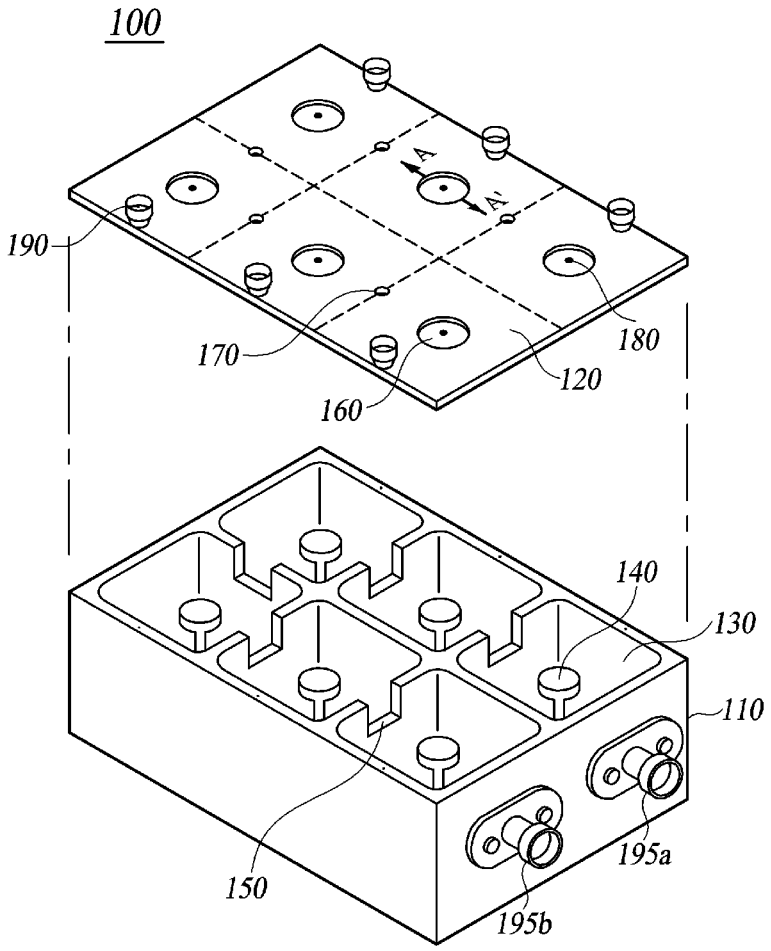
FIG. 1 is an exploded perspective view of an RF filter according to some embodiments of the present disclosure.

| | |
|---|---|
| 10: RF filter | 110: Conductive container |
| 120: Cover | 140: Resonance element |
| 160: Tuning area | 210: Striking unit |
| 300: Automatic RF filter tuning system | |
| 310: Measuring unit | |
| 320: Control unit | |
| 330: Tuning unit | |
| 340: Tuning head | |
| 350: Transfer robot | |
| 710: Fastening unit | |
| 720: Gripper | |

DETAILED DESCRIPTION

Hereinafter, some embodiments of the present disclosure will be described in detail with reference to the accompanying drawings. When adding reference numerals to elements in the drawings, it should be noted that like reference numerals designate like elements as far as possible although the elements are shown in different drawings. Further, in the following description of the embodiments, a detailed description of known configurations or functions incorporated herein will be omitted for the purpose of clarity and for brevity.

In describing elements of some embodiments of the present disclosure, various terms such as first, second, A, B, (i), (ii), (a), (b), etc., may be used. Such terms are used solely for the purpose of differentiating one element from the other but not to imply or suggest the substances, order or sequence of the elements. Throughout this specification, when a portion were described as "comprises" or "includes" an element, the portion is meant to further include other elements, not excluding them, unless otherwise mentioned.

The following will describe an automatic RF filter tuning system and a method for manufacturing a filter using the same according to some embodiments of the present disclosure with reference to the accompanying drawings.

Figure 2A:
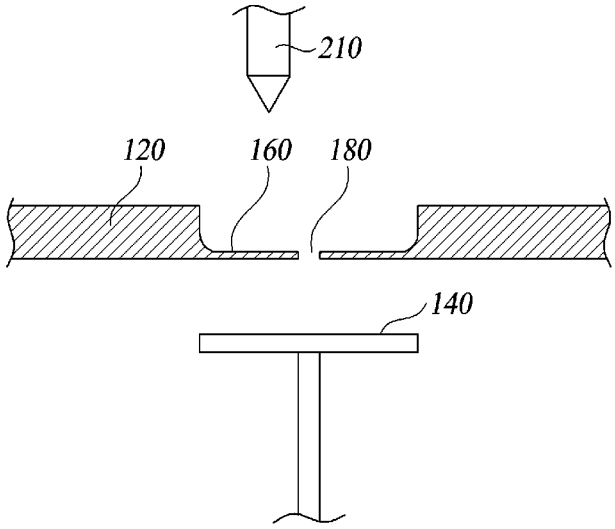
FIG. 2A is a partial cross-sectional view of a cover of FIG. 1 taken along line A-A'.
Figure 2B:
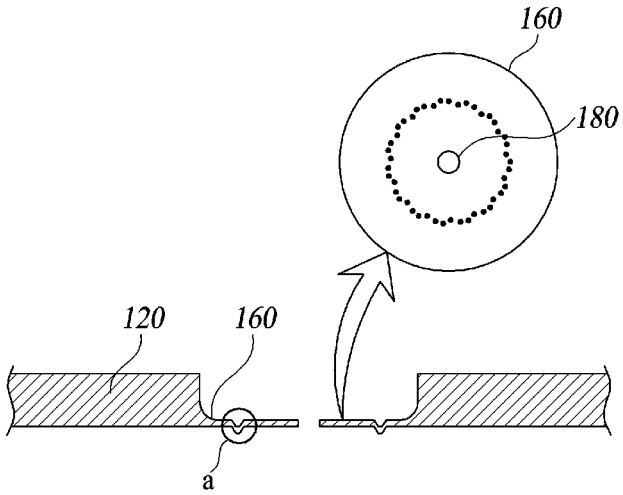
FIG. 2B is an exemplary view illustrating that a dot pattern 'a' is formed on a tuning area of FIG. 2A.

FIG. 1 is an exploded perspective view of an RF filter according to an embodiment of the present disclosure. FIG. 2A is a partial cross-sectional view of a cover of FIG. 1 taken along line A-A'. FIG. 2B is an exemplary view illustrating that a dot pattern is formed on a tuning area (a) of FIG. 2A.

An automatic RF filter tuning system 300 according to some embodiments will be described starting, for convenience's sake, from an RF filter 100 used in the system. As illustrated in FIG. 1, the RF filter 100 includes a conductive container 110 and a cover 120.

The conductive container 110 is internally divided by partitions to construct a plurality of cavities 130 each centrally including a resonance element 140. Further, some of the partitions for dividing the cavities 130 include a coupling window 150 for providing a coupling between neighboring cavities 130.

The cover 120 is adapted to close the top of the conductive container 110, including tuning areas 160 where tuning will be performed by a tuning unit 330 to be described (referring to FIGS. 3 and 4) and thorough holes 170 each adapted to tune a coupling.

As illustrated in FIG. 2A, the tuning area 160 is formed thinner than the rest of the cover 120 so as to be tuned by a tuning unit 330, and is positioned at a portion of the cover 120 correspondingly to the resonance element 140.

Accordingly, when the tuning area 160 is stricken by a striking unit 210, the tuning area 160 has a dot pattern (a) formed therein as illustrated in FIG. 2B.

The tuning area 160 further includes a shorting hole 180 formed centrally thereof, which is inserted with a conductive shorting pin 510 that shorts the resonance element 140 correspondingly to each tuning area 160 when performing a frequency tuning process.

Through holes 170 are each positioned at a portion of the cover 120 correspondingly to the coupling window 150 so that a cut screw (not illustrated) is inserted in the through hole 170 for a coupling tuning between neighboring cavities 130.

The RF filter 100 may further include measuring ports 190 each configured to measure a resonance value of each resonance element 140 by using the measuring unit 310 (FIGS. 3 and 4) when performing the frequency tuning process. Used when tuning the RF filter 100, each measuring port 190 is provided on a side of each cavity 130 and is connected to each resonance element 140.

The RF filter 100 may also include a port 195*a* to be connected with a transmit circuit or a receive circuit and a port 195*b* to be connected with an antenna.

Figure 3:
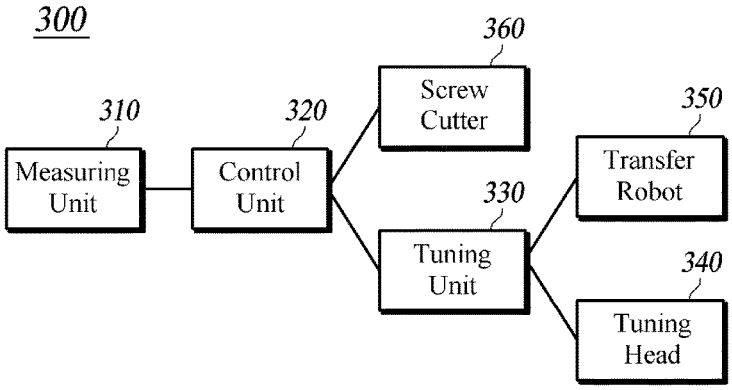
FIG. 3 is a block diagram of an automatic RF filter tuning system according to some embodiments.
Figure 4:
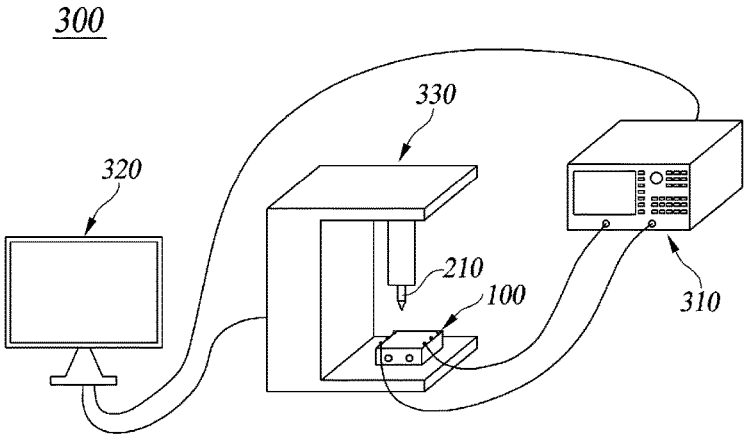
FIG. 4 is a schematic diagram of an automatic RF filter tuning system according to some embodiments.
Figure 5:
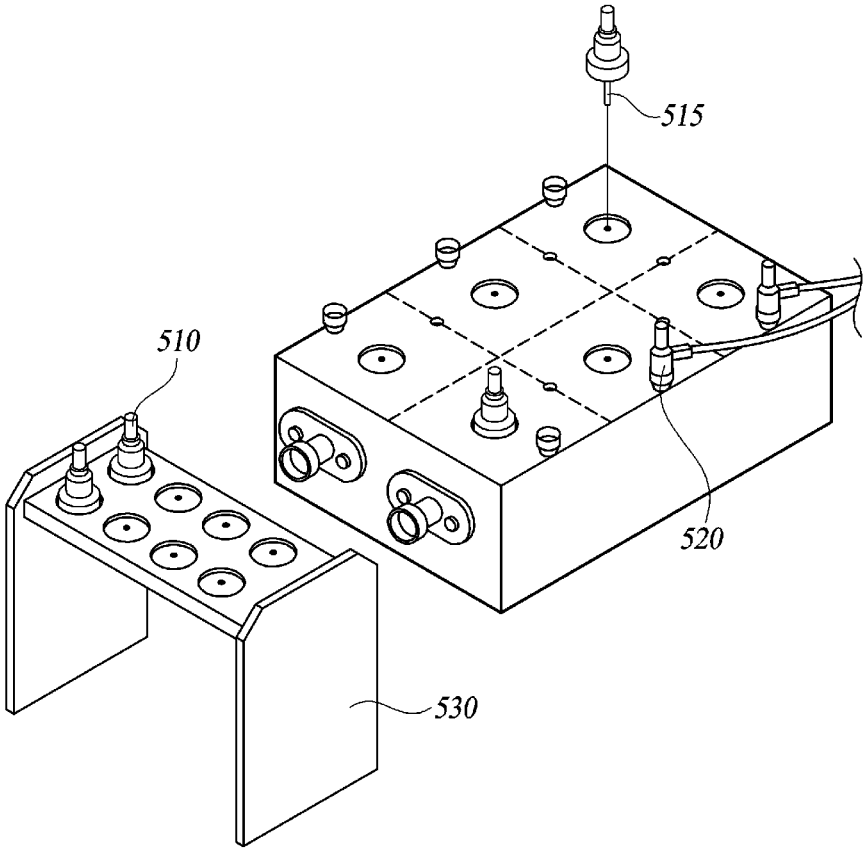
FIG. 5 is an exemplary view in which shorting pins and measuring pins are used according to some embodiments.

FIG. 3 is a block diagram of an automatic RF filter tuning system according to some embodiments of the present disclosure. FIG. 4 is a schematic diagram of an automatic RF filter tuning system according to some embodiments. FIG. 5 is an exemplary view in which shorting pins and measuring pins are used according to some embodiments. Hereinafter, an automatic RF filter tuning system 300 will be described with reference to FIGS. 3 to 5.

As illustrated in FIGS. 3 and 4, the automatic RF filter tuning system 300 according to some embodiments of the present disclosure includes a measuring unit 310, a control unit 320 and a tuning unit 330. When performing a tuning process, the RF filter 100 is placed on a stage of the tuning unit 330.

The measuring unit 310 measures of the RF filter 100. The measuring unit 310 provides the RF filter 100 with an input signal of a predetermined frequency, and then receives an output signal corresponding to the input signal from the RF filter 100, and measures the operating characteristics of the RF filter 100.

The measuring unit 310 may further include at least one measuring pin 520 to be connected to a port of the RF filter 100. The measuring pin 520 in electrical connection with the measuring unit 310 can be connected to a measuring port 190 of the RF filter 100, to determine frequency characteristics of the RF filter 100.

The control unit 320 is linked with the measuring unit 310, to continuously monitor the operating characteristics of the RF filter 100 that are measured by the measuring unit 310. The control unit 320 controls the operation of the tuning unit 330 according to the result of the monitoring until filtering characteristics of the RF filter 100 are optimized or meet their standard.

The control unit 320 is preprogrammed to form a dot pattern 'a' that is properly variable depending on different sizes, thicknesses and/or shapes of the tuning areas 160 included in the RF filter 100.

The control unit 320 also stores information on the positions of the tuning areas 160, through holes 170 and shorting holes 180 that are components of the cover 120 of the RF filter 100 placed on the stage so as to provide an automatic tuning by the tuning unit 330 having a tuning head 340 and a transfer robot 350.

The tuning unit 330 drives a striking unit 210 following a control command received from the control unit 320. The tuning unit 330 imparts mechanical impacts to the tuning area 160 in the RF filter 100 by using the striking unit 210 to form the dot pattern 'a' on the bottom of the tuning area 160 as illustrated in FIG. 2B.

In addition, the tuning unit 330 may be configured to fasten screws to the through hole 170 used to tune the RF filter 100, or to enable the measuring pin 520 or the shorting pin 510 to be transferred, which is described below.

The automatic RF filter tuning system 300 may further include a screw cutter (not illustrated). The screw cutter (not illustrated) cuts a screw (not illustrated) used for the coupling tuning process of the RF filter 100 to a desired length based on a value calculated by the control unit 320.

Accordingly, the screw cutter (not illustrated) is connected with the control unit 320, and the cut screw is fastened to the through hole 170 of the RF filter 100 by a fastening unit 710 to be described below.

As illustrated in FIG. 5, the automatic RF filter tuning system 300 may further include a shorting pin box 530 for containing the shorting pins 510 and unused shorting pins. The shorting pin 510 is a conductive pin for shorting the resonance element 140 of the RF filter. When the shorting pin 510 is inserted into the shorting hole 180 of the cover 120 in the RF filter 100, the shorting pin 510 contacts with the resonance element 140 so that the resonance element 140 is shorted to the cover 120 of the RF filter 100.

The upper portion of the shorting pin 510 is of a size enough to be gripped by a gripper 720 (see FIG. 7) to be described below.

The lower portion 515 of the shorting pin 510 is of a thickness to pass through the shorting hole 180 and of a length to contact with the resonance element 140. The lower portion 515 is connected to the inside of the shorting pin 510 through a spring so that it is responsive to an external pressure for partially entering the inside of the shorting pin 510 to adjust its own length.

The shorting pin box 530 and the screw cutter (not illustrated) described above are positioned within the premises where the tuning unit 330 may move by using a transfer robot 350 to be described below.

Figure 6:
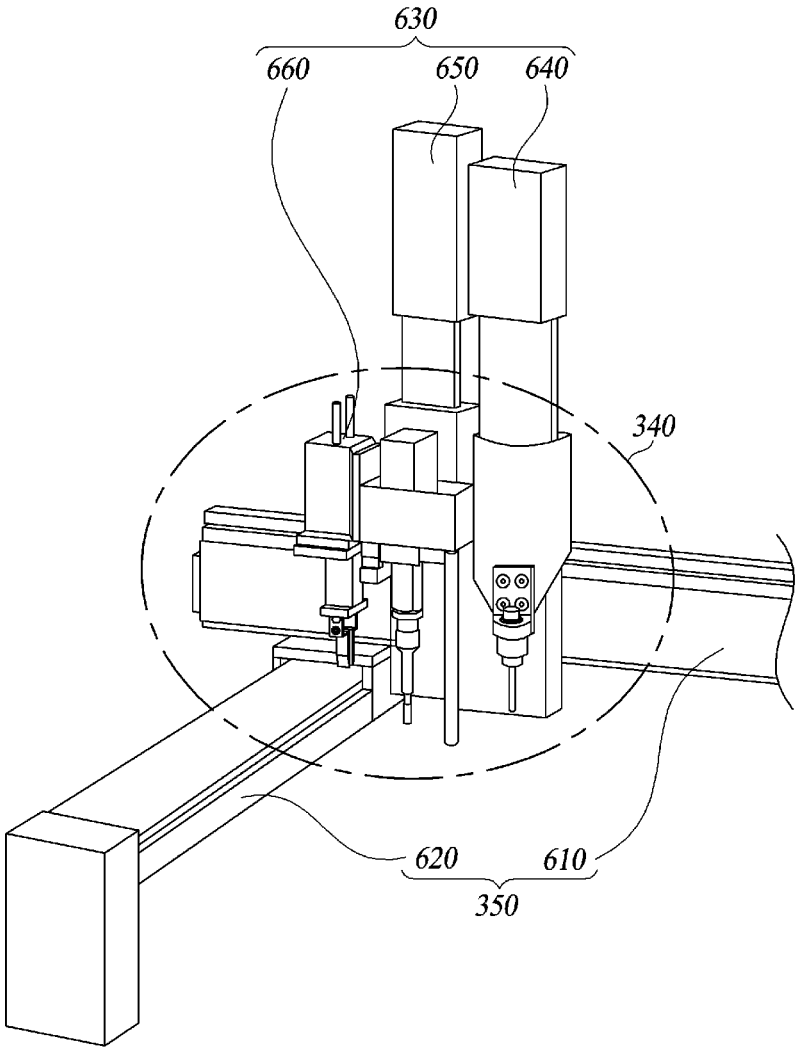
FIG. 6 is a perspective view of a tuning unit according to some embodiments.
Figure 7:
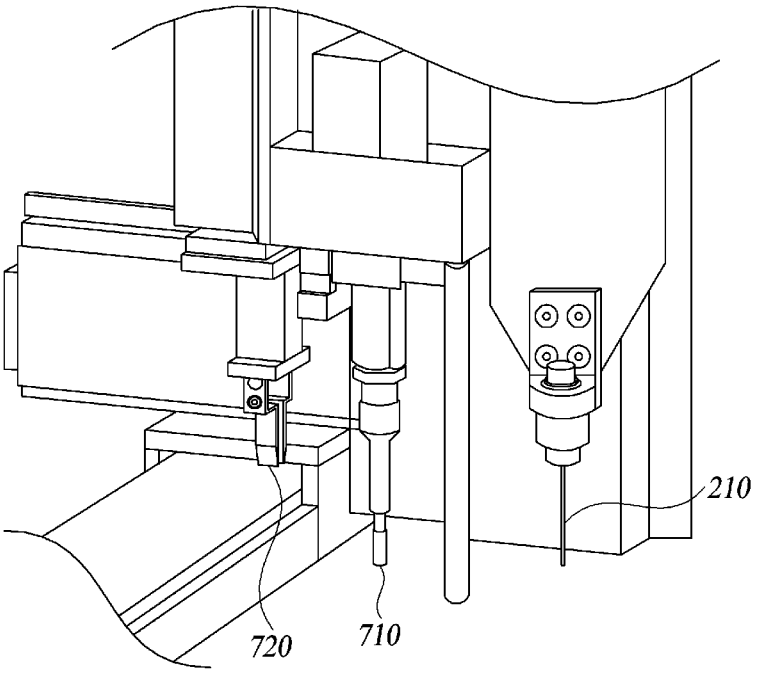
FIG. 7 is a view illustrating a tuning head of a tuning unit according to some embodiments.

FIG. 6 is a perspective view of a tuning unit according to an embodiment of the present disclosure. FIG. 7 is a view illustrating a tuning head of a tuning unit according to an embodiment of the present disclosure. Hereinafter, a tuning unit according to the present embodiment will be described based on FIGS. 6 and 7.

The tuning unit 330, having the tuning head 340 and the transfer robot 350, is adapted to tune the cover 120 of the RF filter 100 at the tuning areas 160 so that they match the resonance elements 140, respectively.

For tuning the RF filter 100, the tuning head 340 includes a striking unit 210, the fastening unit 710, a gripper 720 and a displacement sensor (not illustrated).

The striking unit 210 gives mechanical impacts to each tuning area 160 of the RF filter 100 to form a dot pattern 'a' on the tuning area 160 and thereby subtly or microscopically narrows the distance between the tuning area 160 and the resonance element 140 thereunder to adjust frequency characteristics of the RF filter.

For striking the tuning area 160, the striking unit 210 is formed in a pin shape to strike the tuning area 160 microscopically and thereby tune the RF filter 100. The upper portion of the striking unit 210 is connected to a Z-axis body 630 to be described below so that the striking unit 210 may move in the Z-axis direction (in the perpendicular direction to the ground) or strike the tuning area 160.

The gripper 720 grips the upper portion of the shorting pin 510 or the measuring pin 520 to move the shorting pin 510 used in the tuning process of the RF filter 100 to the shorting hole 180 above the resonance element 140 to be shorted or to move the measuring pin 520 of the measuring unit 310 to the corresponding port position.

Accordingly, the gripper 720 includes a gripper for gripping the shorting pin 510 or the measuring pin 520 by an upper portion thereof. Here, it is desirable that the upper portions of the shorting pin 510 and the measuring pin 520 have such similar shape and size so that the gripper 720 may easily grip them.

The fastening unit 710 moves the screw cut by the screw cutter (not illustrated) in the process of tuning the coupling between the cavities of the RF filter 100, from the screw cutter to the through hole 170 of the RF filter 100 and fasten the same to the through hole 170.

A displacement sensor (not illustrated) is used to transmit the current position of the tuning head 340 to the control unit 320 so that the control unit 320 moves the tuning head 340 to a desired position on the RF filter 100.

In addition, the displacement sensor (not illustrated) enables a tuning process to be performed on a correct position on the RF filter 100, in consideration of distances from the displacement sensor to the striking unit 210, the gripper 720 and the fastening unit 710 when one of these components of the tuning head 340 is operated.

The transfer robot 350 is connected with the tuning head 340 so that a proper number and shape of the dot shape 'a' is formed on the tuning area 160 of the cover 120 of the RF filter 100. The transfer robot 350 moves the tuning head 340 to a proper position to transfer the shorting pin to the shorting hole 180 or to fasten a cut screw to the through hole 170.

The transfer robot 350 enables the tuning head 340 to move above the stage on which the RF filter 100 is placed, horizontally to the upper surface of the RF filter 100 and to the ground.

The transfer robot 350 includes an X-axis body 610 and a Y-axis body 620 for respectively moving the tuning head 340 in the X-axis direction that is horizontal to the ground and in the Y-axis direction that is horizontal to the ground and perpendicular to the X-axis. The Y-axis body 620 is a bar-shaped fixture elongated in the Y-axis direction.

The X-axis body 610 is elongated in the X-axis direction, and a lower portion of the X-axis body 610 is connected to the top of the Y-axis body 620 such that the X-axis body 610 moves in the Y-axis direction along the Y-axis body 620.

The tuning head 340 is connected to an upper portion or side portion of the X-axis body 610, so that the tuning head 340 moves in the X-axis direction along the X-axis body. Resultantly, the tuning head 340 may freely move to a desired position on the RF filter 100 in the X and Y axis directions in order to tune the RF filter 100 by the transfer robot 350.

When the tuning head 340 moves by the transfer robot 350 in the X-axis direction, Y-axis direction or X-Y axis direction, the tuning head 340, i.e., the constituents of the striking unit 210, the gripper 720 and the fastening unit 710 maintain a predetermined distance or farther apart from the top of the RF filter 100 to prevent some of the constituents from contacting the top of the RF filter 100 so as not to disturb the movement of the tuning head 340 in the X-Y direction.

The transfer robot 350 may further include a Z-axis body 630. The Z-axis body 630 is elongated in the Z-axis direction for moving the tuning head 340 in the Z-axis direction.

However, the Z-axis body 630 can be separated in order to be provided for each of the striking unit 210, the gripper 720 and the fastening unit 710 of the tuning head 340. That is, when performing the tuning process, the striking unit 210 may move along a first Z-axis body 640, the fastening unit 710 move along a second Z-axis body 650, and the gripper 720 move along a third Z-axis body 660, to perform its own independent movement.

Accordingly, when any one constituent of the tuning head 340, that is, the striking unit 210, the gripper 720 or the fastening unit 710 performs a tuning task, it may be possible that a constituent needed for the tuning task only comes down toward the filter in the Z-axis direction to perform the task.

The tuning head 340 freely moves by the transfer robot 350 to tune the RF filter, and the transfer robot 350 described above is merely an exemplary and thus the transfer robot may be modified in a different type that may move the tuning head 340, to the extent that it may be easily derived by those skilled in the art.

Figure 8:
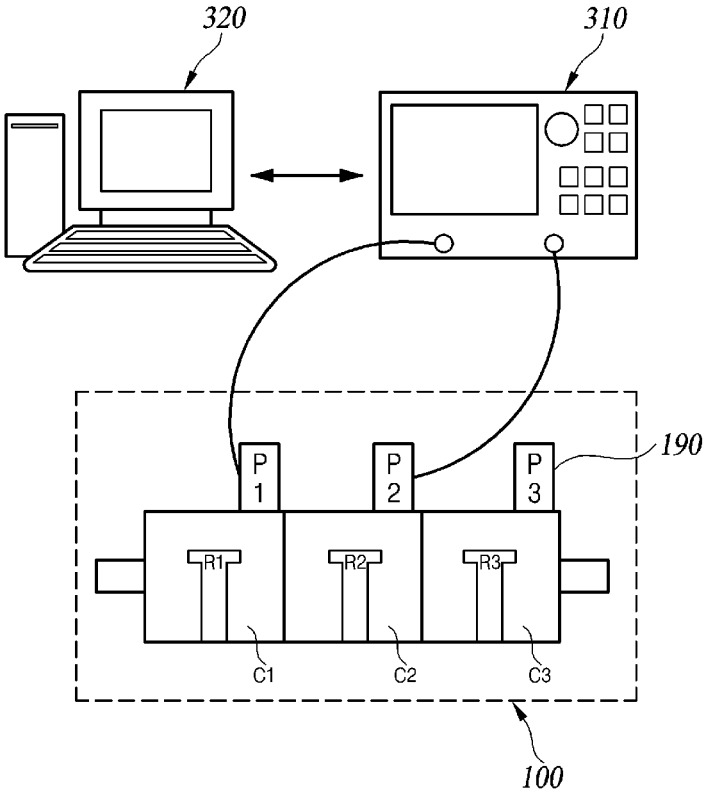
FIG. 8 is a view illustrating a tuning method using an automatic RF filter tuning system according to some embodiments.
Figure 9:
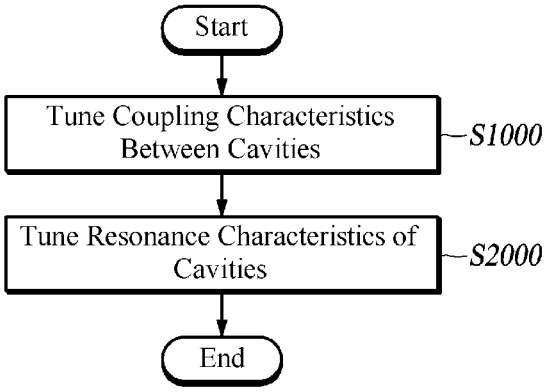
FIG. 9 is a schematic flowchart illustrating an RF filter tuning method using an automatic RF filter tuning system according to some embodiments.
Figure 10:
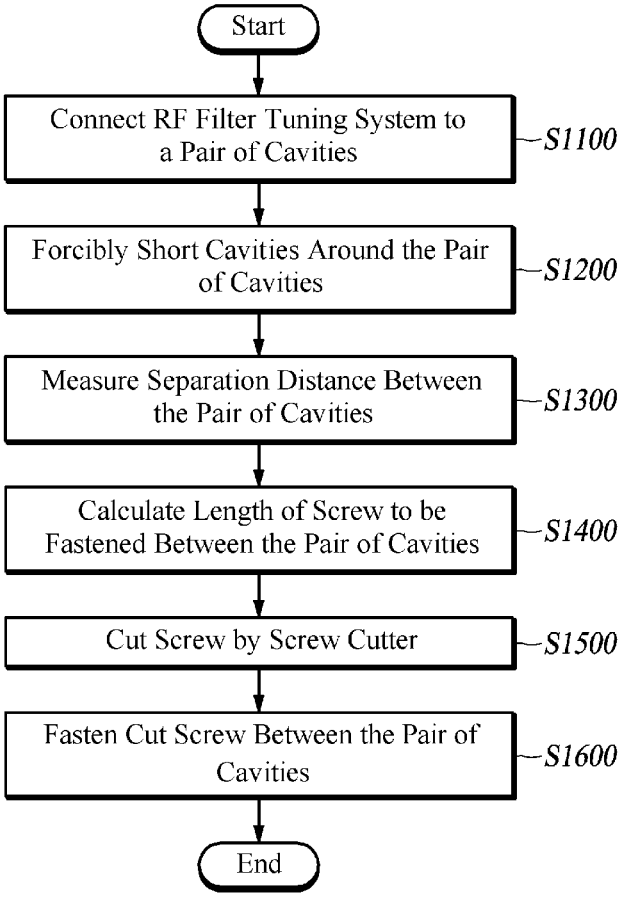
FIG. 10 is a detailed flowchart illustrating a process of tuning a coupling value between cavities of an RF filter according to some embodiments.

FIG. 8 is a view illustrating a tuning method using an automatic RF filter tuning system according to an embodiment of the present disclosure. FIG. 9 is a schematic flowchart illustrating an RF filter tuning method using an automatic RF filter tuning system according to an embodiment of the present disclosure. FIG. 10 is a detailed flowchart illustrating a process of tuning a coupling value between cavities of an RF filter according to an embodiment of the present disclosure.

Figure 11:
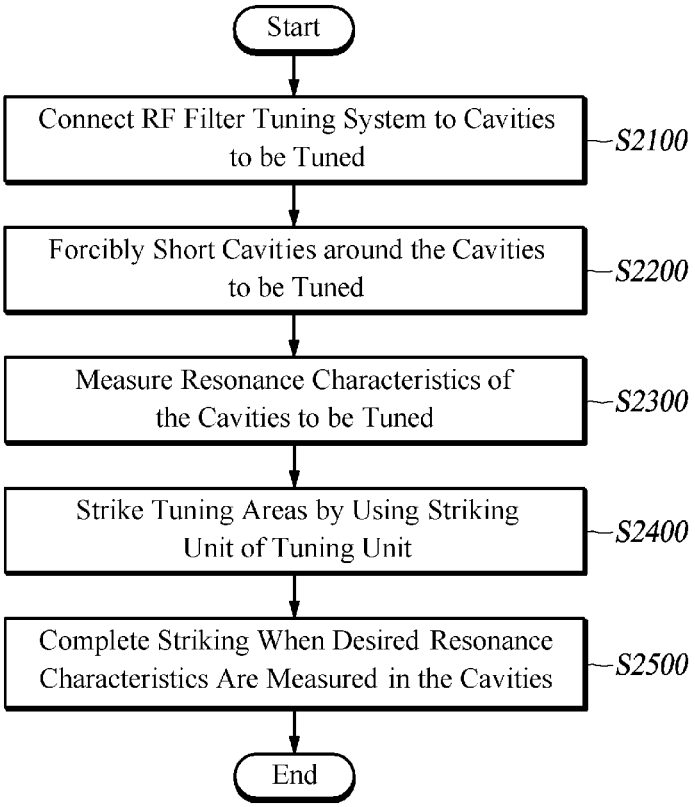
FIG. 11 is a detailed flowchart illustrating a process of tuning a resonance value of a cavity of an RF filter according to some embodiments.

FIG. 11 is a detailed flowchart illustrating a process of tuning a resonance value of a cavity of an RF filter according to an embodiment of the present disclosure. FIG. 12 is a flowchart illustrating a tuning order of a coupling value between resonance elements for respective resonance elements of an RF filter including a plurality of cavities disclosed in FIG. 9 according to an embodiment of the present disclosure and a flowchart illustrating a tuning order of resonance values of respective cavities of an RF filter including a plurality of cavities disclosed in FIG. 9 according to an embodiment of the present disclosure.

Hereinafter, an RF filter tuning method using an automatic RF filter tuning system according to the present embodiment will be described based on FIGS. 8 to 12.

A tuning process of the RF filter 100 will be described based on a general RF filter 100 including three resonance elements R1, R2 and R3 and 3 measuring ports P1, P2 and P3 connected to the three resonance elements, respectively, illustrated in FIG. 8.

As illustrated in FIG. 9, the RF filter 100 tuning method generally includes processes of tuning a coupling value between cavities 130 (S1000) and tuning a resonance value of each cavity (S2000), through which the RF filter is entirely tuned.

As illustrated in FIG. 10, the process of tuning a coupling value between cavities 130 (S1000) is performed in a way that cavities other than a pair of cavities 130 whose coupling value will be tuned are shorted to obtain a coupling value between the pair of cavities 130 and then a screw corresponding to the coupling value is fastened to a through hole 170.

When performing a process of connecting the measuring unit to the two cavities 130 that are connected each other by a coupling window 150 (S1100), a process of tuning a coupling value between the pair of cavities 130 is started.

According to the present embodiment, the measuring pin 520 connected to the measuring unit 310 is connected to the first and second ports P1 and P2 that are connected to a pair of cavities C1 and C2 to be measured, respectively. It is performed to obtain a coupling value needed between the first and second cavities C1 and C2 by using the measuring unit.

A process of forcibly shorting cavities around the cavities connected to the measuring unit 310 is performed (S1200).

According to the present embodiment, a third cavity C3 positioned around the second cavity C2 is forcibly shorted. A shorting pin 510 is inserted into the shorting hole 180 corresponding to the third cavity C3 of the cover 120 so that a signal generated in the third cavity C3 is isolated. The isolation is performed to remove unnecessary variables when measuring a coupling value between the first and second cavities C1 and C2.

A process is performed for measuring a separation distance between the cavities 130 connected to the measuring unit 310 (S1300).

According to the present embodiment, a resonance separation distance (coupling) between the first and second cavities C1 and C2 is measured through the first and second ports P1 and P2. There is a coupling window 150 between the first and second cavities C1 and C2, which allows to perform the measurement.

The control unit 320 performs a process of calculating the length of a screw to be fastened to the through hole 170 between the cavities 130 connected to the measuring unit 310 (S1400).

According to the present embodiment, the length of the screw to be fastened between the first and second cavities C1 and C2 is calculated based on the identified resonance separation distance. The desired length of the screw is calculated by comparing the value stored in the control unit 320 and the value calculated by the measuring unit 310.

The screw cutter (not illustrated) performs a process of cutting the screw (S1500). The screw cutter cuts the screw based on the value calculated by the control unit 320 so that the screw has the desired length.

The fastening unit 710 performs a process of fastening the cut screw to the through hole 170 between the cavities 130 connected to the measuring unit 310 (S1600).

According to the present embodiment, the cut screw is fastened to the through hole 170 between the first and second cavities C1 and C2. A separation error of the coupling value between the first and second cavities C1 and C2 is corrected by fastening the screw cut by the screw cutter (not illustrated) to the through hole 170.

Figure 12A:
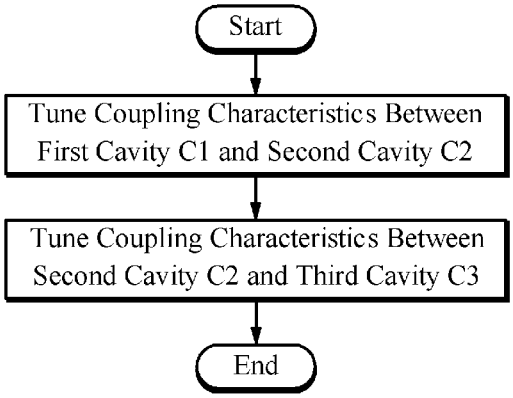
FIG. 12A is a flowchart illustrating a tuning order of a coupling value between resonance elements for respective resonance elements of an RF filter including a plurality of cavities disclosed in FIG. 9 according to some embodiments.

As illustrated in FIG. 12A, a process of tuning the coupling value between remaining cavities is performed through the processes S1100 to S1600. According to the embodiment illustrated in FIG. 8, a coupling value between R2 and R3 is tuned thereafter. Unlike the illustration in FIG. 8, however, in case of the RF filter 100 including more cavities 130, resonance elements 140 and coupling windows 160, all the coupling values of the respective cavities 130 connected to the coupling window 160 need to be obtained.

A process of tuning coupling values between the resonance elements 140 is completed upon obtaining all the coupling values according to the resonance element 140 within respective cavities 130 connected to the coupling windows 160 in the RF filter 100 and then fastening the cut screw to the through hole 170.

Upon completing the coupling tuning process between all the cavities 130 in the RF filter 100 (S1000), a process is performed for tuning a resonance value of respective cavities 130 (S2000).

As illustrated in FIG. 11, a process is performed for connecting the measuring unit 310 to the cavities 130 to be tuned (S2100).

According to the present embodiment, in order to detect an internal signal of a product, a measuring pin 520 of the measuring unit 310 is connected to the first port P1 connected to the first cavity C1 to measure a resonance value of the first cavity C1.

A process is performed for forcibly shorting cavities around the cavity 130 to be tuned (S2200).

According to the present embodiment, a short pining 510 is inserted into the short hole 180 positioned on the second and third cavities C2 and C3 to forcibly short the second and third cavities C2 and C3 around the first cavity C1. The shorting pin 510 is made to contact with the second and third resonance elements R2 and R3 within the second and third cavities C2 and C3, so that the second and third cavities C2 and C3 of the RF filter are forcibly shorted.

The above process is performed to remove unnecessary variables when measuring the resonance value of the first cavity C1.

A process is performed for identifying a resonance position of the cavity 130 to be tuned (S2300).

According to the present embodiment, a resonance position of the first cavity C1 is determined by using the measuring unit 310 connected to the first port P1. This is performed to calculate a tuning value needed in the tuning area 160 of the first cavity C1.

A process is performed for striking the tuning area 160 of the RF filter 100 by the striking unit 160 of the tuning unit 330 (S2400).

According to the present embodiment, the control unit 320 calculates the determined resonance position to strike the tuning area 160 of the cover of the RF filter 100 on the first cavity C1 by using the striking unit 210 of the tuning unit 330.

As illustrated in FIG. 2B, a process is performed for striking the tuning area 160 by the striking unit 210 to form the dot pattern (a) so that the distance may be adjusted between the first resonance element R1 and the tuning area 160.

When a desired resonance value is measured by the striking of the striking unit 210 in the resonance element 140 connected to the measuring unit 310, the control unit 320 performs a process of completing the striking (S2500).

According to the present embodiment, the dot pattern 'a' is formed on the tuning area 160 of the RF filter 100 so that when a desired resonance value is measured from the measuring unit 310 in the first cavity C1, the striking is completed in the tuning area 160. This completes the tuning for the first cavity C1.

Figure 12B:
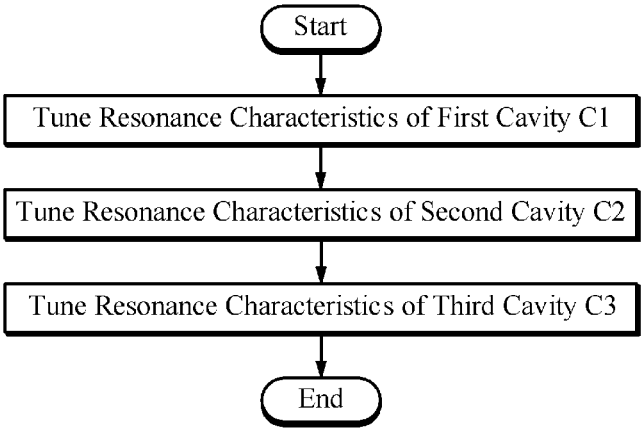
FIG. 12B is a flowchart illustrating a tuning order of resonance values of respective cavities of an RF filter including a plurality of cavities disclosed in FIG. 9 according to some embodiments.

As illustrated in FIG. 12B, the completed tuning process of a resonance value of the first cavity C1 is followed by processes (S2000) of tuning resonance value for remaining cavities C2 and C3 by the above method (S2100 to S2500).

However, unlike the illustration in FIG. 8, in case where the RF filter 100 includes more cavities 130, all the resonance values for respective cavities 130 need to be obtained. When the tuning of resonance values for all the cavities is completed by the method described above, the tuning for all the RF filters 100 is completed.

The present embodiments are provided in order not to restrict but describe the technical spirit of the present disclosure, so the scope of the present disclosure is not limited thereto. It should be construed that the scope of the present disclosure is defined by the accompanying claims and all equivalence within the scope of the disclosure is included in the accompanying claims.

The invention claimed is:

1. An RF filter tuning system for tuning an RF filter that includes a plurality of cavities having resonance elements and a cover having tuning areas that are positioned correspondingly to the resonance elements, the RF filter tuning system comprising:

a measuring unit configured to measure resonance characteristics of the plurality of the cavities of the RF filter and a separation distance between at least a pair of the cavities;

a control unit configured to calculate a tuning value of the RF filter based on the resonance characteristics;

a tuning unit configured to tune the RF filter based on the tuning value calculated by the control unit; and a screw cutter configured to cut a screw based on the separation distance between at least the pair of the cavities, wherein the tuning unit includes a striking unit configured to strike the tuning area of the cover of the RF filter to adjust a resonance value and a fastening unit configured to fasten the screw cut by the screw cutter between at least the pair of the cavities, thereby tuning the RF filter.

2. The RF filter tuning system of claim 1, further comprising a transfer robot configured to move the striking unit of the tuning unit above the RF filter.

3. The RF filter tuning system of claim 2, wherein the tuning unit comprises a tuning head having the striking unit and the fastening unit, wherein the transfer robot moves the tuning head.

4. The RF filter tuning system of claim 3, wherein the transfer robot comprises an X-axis body configured to transfer the tuning head in an X-axis direction which is horizontal to a ground and a Y-axis body configured to transfer the X-axis body in a Y-axis direction which is horizontal to the ground and perpendicular to the X-axis, and wherein the transfer robot is configured to move the tuning head in the X-axis direction, in the Y-axis direction, or in an X-Y axis direction.

5. The RF filter tuning system of claim 4, wherein the transfer robot further comprises a Z-axis body configured to transfer the tuning head in a Z-axis direction which is perpendicular to the ground.

6. The RF filter tuning system of claim 5, wherein the Z-axis body comprises a first Z-axis body and a second Z-axis body, wherein the striking unit is connected to the first Z-axis body to move in the Z-axis direction, and wherein the fastening unit is connected to the second Z-axis body to move in the Z-axis direction.

7. The RF filter tuning system of claim 4, further comprising: a conductive shorting pin configured to short the resonance elements of the RF filter; and a shorting pin box configured to accommodate the shorting pin.

8. The RF filter tuning system of claim 7, wherein the measuring unit further comprises a measuring pin connected to the RF filter to measure the resonance characteristics of the RF filter.

9. The RF filter tuning system of claim 8, wherein the tuning head further comprises a gripper configured to move the shorting pin or the measuring pin.

10. The RF filter tuning system of claim 8, wherein an upper portion of the shorting pin and an upper portion of the measuring pin both have similar shape and size to be easily gripped by the gripper.

11. A method for tuning an RF filter using an RF filter tuning system, wherein the RF filter includes a plurality of cavities having resonance elements and a cover having tuning areas that are positioned correspondingly to the resonance elements, the method comprising:

measuring resonance characteristics of the plurality of the cavities to be tuned; striking the tuning areas by a striking unit of a tuning unit of the RF filter tuning system; and completing the striking when a measured value of resonance characteristics of the plurality of the cavities correspond to a desired value of resonance characteristics of the plurality of the cavities, wherein the method further comprises, prior to measuring the resonance characteristics:

measuring a separation distance between a pair of the cavities;

calculating a length of a screw to be fastened between the pair of the cavities; cutting the screw by a screw cutter; and fastening the cut screw between the pair of the cavities.

12. The method of claim 11, further comprising, prior to the measuring of the resonance characteristics, forcibly shorting remaining cavities around the pair of the cavities to be tuned.

13. The method of claim 12, further comprising, prior to forcibly shorting the remaining cavities, connecting the RF filter tuning system to the pair of the cavities to be tuned.

14. The method of claim 13, wherein all method steps are performed with respect to all of the plurality of the cavities included in the RF filter.

15. The method of claim 14, further comprising, prior to measuring the separation distance between the pair of the cavities, forcibly shorting the remaining cavities around the pair of the cavities.

16. The method of claim 15, further comprising, prior to forcibly shorting the remaining cavities around the pair of the cavities, connecting the RF filter tuning system to the pair of the cavities.

17. The method of claim 16, further comprising processes, performed by the RF filter tuning system of:

connecting the RF filter tuning system to the pair of the cavities with respect to all consecutive pairs of the cavities, and fastening the cut screws between the pairs of the cavities.

* * * * *